US008521584B1

(12) United States Patent
Feng et al.

(10) Patent No.: US 8,521,584 B1
(45) Date of Patent: Aug. 27, 2013

(54) CO-SPONSORED CONTENT

(75) Inventors: Paul Feng, Palo Alto, CA (US); Surojit Chatterjee, Fremont, CA (US)

(73) Assignee: Google Inc., Mountain View, CA (US)

( * ) Notice: Subject to any disclaimer, the term of this patent is extended or adjusted under 35 U.S.C. 154(b) by 294 days.

(21) Appl. No.: 12/896,083

(22) Filed: Oct. 1, 2010

(51) Int. Cl.
*G06Q 30/00* (2012.01)

(52) U.S. Cl.
USPC ..... 705/14.1

(58) Field of Classification Search
USPC ..... 705/14.1
See application file for complete search history.

(56) References Cited

U.S. PATENT DOCUMENTS 6,173,274 B1 * 1/2001 Ryan, Jr. ..... 705/408

* cited by examiner

*Primary Examiner* — Daniel Lastra
(74) *Attorney, Agent, or Firm* — Fish & Richardson P.C.

(57) ABSTRACT

Methods, systems, and apparatus, including computer programs encoded on a computer storage medium, for distribution of co-sponsored content items. In one aspect, a method includes receiving a first bid from a first content distributor and a second bid from a second content distributor, where each of the bids specifying respective amounts that the different content distributors will pay for distribution of respective content. Using the first and the second bid, a total bid is computed for a co-sponsored content item that includes the first content and the second content. A request is received for content to be presented in a presentation slot of a publisher property and the co-sponsored content item is selected for presentation based on the outcome of an auction performed using the total bid as one of a plurality of bids. In turn, data that cause presentation of the co-sponsored content item in the presentation slot of the publisher property are provided.

21 Claims, 7 Drawing Sheets

CO-SPONSORED CONTENT

BACKGROUND

This specification relates to content distribution.

The Internet provides access to a wide variety of resources. For example, video and/or audio files, as well as web pages for particular subjects or particular news articles are accessible over the Internet. Access to these resources presents opportunities for advertisements to be provided with the resources. For example, a web page can include advertisement slots in which advertisements can be presented. These advertisements slots can be defined in the web page or defined for presentation with a web page, for example, in a pop-up window.

Advertisement slots can be allocated to advertisers through an auction. For example, advertisers can provide bids specifying amounts that the advertisers will respectively pay for presentation of their advertisements. In turn, an auction can be performed and the advertisement slots can be allocated to advertisers according to auction scores (e.g., bids received from the advertisers or scores that are computed as a function of the bids). When one advertisement slot is being allocated in the auction, the advertisement slot can be allocated to the advertiser that is the winning bidder (e.g., a bidder that is associated with a winning auction score). When multiple advertisement slots are allocated in a single auction, the advertisement slots can be respectively allocated to a set of winning bidders that are associated with winning auction scores (e.g., highest bids, highest auction scores, or highest values resulting from a function of, bids, auction scores, and/or other parameters). The bid that is associated with a winning auction score is referred to as a winning bid.

Each advertisement slot is generally allocated to a single bidder. For example, if three advertisement slots are available, three separate bidders are each allocated one of the advertisement slots. In some situations, an advertiser may be willing to allow another advertiser to present content in a portion of their advertisement (i.e., co-sponsoring the advertisement), for example, in exchange for the other advertiser paying a portion of the cost of the advertisement slot. However, it can be difficult and time consuming for some advertisers to enter into agreements with other advertisers.

SUMMARY

In general, one innovative aspect of the subject matter described in this specification can be embodied in methods that include the actions of receiving, from a first content distributor, a first bid specifying a first amount that the first content distributor will pay for distribution of first content; receiving, from a second content distributor that is different from the first content distributor, a second bid specifying a second amount that the second content distributor will pay for distribution of second content with the first content; computing a total bid for a co-sponsored content item that includes the first content and the second content, the total bid being computed using the first bid and the second bid; receiving a request for content to be presented in a presentation slot of a publisher property; selecting, based on the outcome of an auction performed using the total bid as one of a plurality of bids, the co-sponsored content item including the first content and the second content to be provided in response to the request for content; and providing data that cause presentation of the co-sponsored content item in the presentation slot of the publisher property. Other embodiments of this aspect include corresponding systems, apparatus, and computer programs, configured to perform the actions of the methods, encoded on computer storage devices.

These and other embodiments can each optionally include one or more of the following features. Methods can further include the actions receiving, from the first content distributor, data specifying a content template that the first content distributor has selected for creating the content item, the content template specifying a first portion for presentation of the first content, and further specifying a second portion of the template that is reserved for content from another content distributor; and inserting the first content into the first portion of the template and the second content into the second portion of the template to create the co-sponsored content item including the first content and the second content.

Methods can further include the action associating at least one URL with content included in the co-sponsored content item, wherein user selection of the content associated with the URL initiates a request for a resource associated with the URL. Associating at least one URL with content included in the co-sponsored content item can include associating a first URL with the first content, wherein user selection of the first content initiates a request for a first resource associated with the first content publisher. Associating at least one URL with content included in the co-sponsored content item can further include associating a second URL, different from the first URL, with the second content, wherein user select of the second content initiates a request for a second resource that is different from the first resource.

Methods can also include the actions receiving, from a third content distributor, a third bid specifying a third amount that the third content distributor will pay for distribution of third content with the first content; the amount being less than the second amount; and selecting, based on the outcome of an auction performed using the second bid and the third bid, the second content as content to be distributed with the first content.

Methods can further include the actions receiving, from the second content distributor, an available content request that requests data specifying co-sponsor preferences with which available content is selected, wherein available content is content having attributes that match the co-sponsor preferences; and providing, in response to the available content request, data specifying available content, the available content including the first content.

In some implementations, receiving the first bid can include receiving a null bid specifying a value of zero. Computing a total bid can include computing a mathematical sum of the first bid and the second bid. The first content can include first advertisement content. The second content can include second advertisement content that is different than the first advertisement content. The publisher property can be a publisher web page. The content item can be an advertisement that includes the first advertisement content and the second advertisement content. Receiving the second bid can include receiving a negative bid.

Another innovative aspect of the subject matter described in this specification can be embodied in methods that include the actions of receiving, from a first content distributor, a first bid and first co-sponsor preferences, the first bid specifying a first amount that the first content distributor will pay for distribution of the first content, the first co-sponsor preferences specifying attributes with which other content must be associated in order for the other content to be included in a co-sponsored content item with the first content; receiving, from a second content distributor, a second bid and second co-sponsor preferences, the second bid specifying a second amount that the second content distributor will pay for distribution of the second content, the second co-sponsor preferences specifying attributes with which other content must be associated in order for the other content to be included in a co-sponsored content item with the second content; determining that the first content is associated with attributes that satisfy the second co-sponsor preferences and that the second content is associated with attributes that satisfy the first co-sponsor preferences; and creating a co-sponsored content item that includes the first content and the second content.

Particular embodiments of the subject matter described in this specification can be implemented so as to realize one or more of the following advantages. Content distributors (e.g., advertisers) can more efficiently identify other content distributors that are interested in co-sponsoring content items (e.g., advertisements).

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
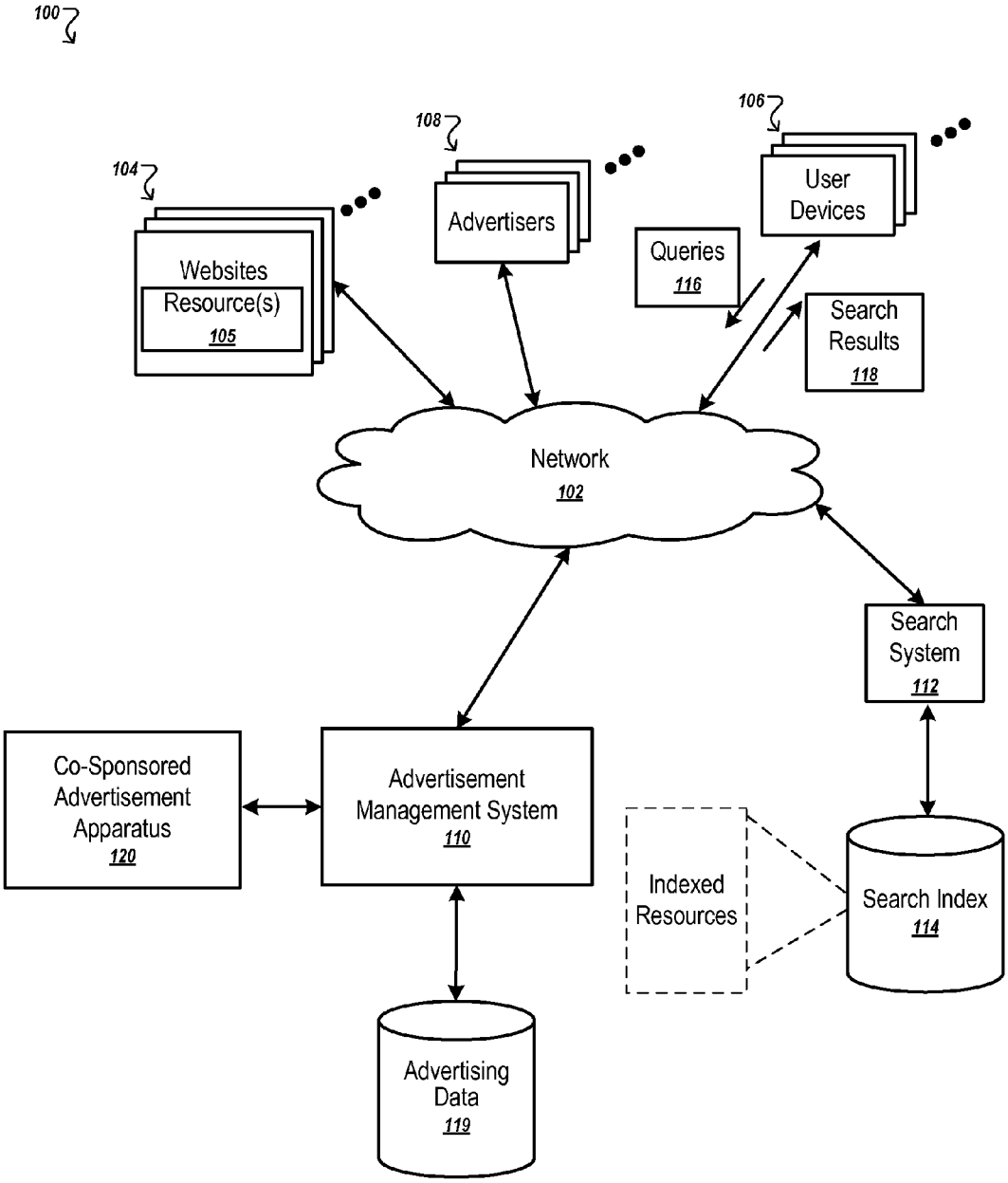
FIG. 1 is a block diagram of an example environment in which content items are distributed by a content distribution system.

Co-sponsored content items (e.g., advertisements, text, audio, and/or video) are generated and presented to users in response to a request for content items. Content items are units of content that are presented in resources (e.g., web pages). Co-sponsored content items are content items that include content (e.g., advertising content) provided by two or more content distributors (e.g., advertisers). For example, a co-sponsored content item can include advertisement content that is provided by a first advertiser (e.g., a small diner) and a logo or brand name for another advertiser (e.g., a large soda distributor).

In some implementations, the content that is selected for inclusion in a particular co-sponsored content item is selected, for example, based on co-sponsor preferences specified by one or more of the content distributors. Co-sponsor preferences are data used to select content that is approved for inclusion in a co-sponsored content item. For example, each particular advertiser can specify that advertising content having specified attributes, specified advertising content, and/or advertising content from specified advertisers are approved to be included in a co-sponsored advertisement with advertising content provided by the particular advertiser. In turn, a co-sponsored advertisement (or other content item) can be created using the advertising content provided by the particular advertiser and approved content (i.e., advertising content that is approved for inclusion in the co-sponsored content item).

Co-sponsored content items are selected for presentation according to an auction using a total bid that specifies an amount that the two or more content distributors will collectively pay for distribution of the co-sponsored content item. For example, if two advertisers respectively bid $1.00/click and $2.00/click, the total bid for a co-sponsored advertisement including advertising content from these two advertisers can be set to $3.00/click and used in an auction for advertising slots. Co-sponsored content items that are associated with winning bids are provided for presentation in response to the content item request, and the advertisers pay respective proportions of the price charged for distributing the co-sponsored advertisement. For example, continuing with the example above, the advertiser that bid $1.00 may pay ⅓ of the price charged (e.g., ($1.00/$3.00)*price), while the advertiser that bid $2.00 may pay ⅔ of the price charged (e.g., ($2.00/$3.00) *price).

The description that follows describes co-sponsored content items as being co-sponsored advertisements that are provided for advertisers. The co-sponsored advertisements can be advertisements that are selected for presentation with search results pages and/or advertisements that are selected for presentation with pages that are not search results pages (e.g., advertisements that are presented with a retailer's web page, a blog web page, a news web page, or another publisher's web page). Co-sponsored content items can also be created using other content (e.g., audio, video, games, and other multimedia content) that is provided by other content distributors. The description that follows also describes the co-sponsored content items as being created and provided by a co-sponsored advertisement apparatus that is coupled to an advertisement management system. However, the co-sponsored advertisement apparatus can be implemented as an independent apparatus that is accessed, for example, over a data network.

FIG. 1 is a block diagram of an example environment 100 in which content items are distributed by a content distribution system. For example, the environment 100 includes an advertisement management system 110 that manages advertising services. The example environment 100 also includes a network 102, such as a local area network (LAN), a wide area network (WAN), the Internet, or a combination thereof. The network 102 connects websites 104, user devices 106, advertisers 108, and the advertisement management system 110. The example environment 100 may include many thousands of websites 104, user devices 106, and advertisers 108.

A website 104 is one or more resources 105 associated with a domain name and hosted by one or more servers. An example website is a collection of web pages formatted in hypertext markup language (HTML) that can contain text, images, multimedia content, and programming elements, such as scripts. Each website 104 is maintained by a publisher, which is an entity that controls, manages and/or owns the website 104.

A resource 105 is any data that can be provided over the network 102. A resource 105 is identified by a resource address that is associated with the resource 105. Resources include HTML pages, word processing documents, and portable document format (PDF) documents, images, video, and feed sources, to name only a few. The resources can include content, such as words, phrases, images and sounds, that may include embedded information (such as meta-information in hyperlinks) and/or embedded instructions (such as JavaScript scripts).

A user device 106 is an electronic device that is under control of a user and is capable of requesting and receiving resources over the network 102. Example user devices 106 include personal computers, mobile communication devices, and other devices that can send and receive data over the network 102. A user device 106 typically includes a user application, such as a web browser, to facilitate the sending and receiving of data over the network 102.

A user device 106 can request resources 105 from a website 104. In turn, data representing the resource 105 can be provided to the user device 106 for presentation by the user device 106. The data representing the resource 105 can also include data specifying a portion of the resource or a portion of a user display (e.g., a presentation location of a pop-up window or in a specified area of a web page) in which advertisements can be presented. These specified portions of the resource or user display are referred to as advertisement slots.

To facilitate searching of these resources 105, the environment 100 can include a search system 112 that identifies the resources 105 by crawling and indexing the resources 105 provided by the publishers on the websites 104. Data about the resources can be indexed based on the resource 105 to which the data corresponds. The indexed and, optionally, cached copies of the resources 105 are stored in a search index 114.

User devices 106 can submit search queries 116 to the search system 112 over the network 102. In response, the search system 112 accesses the search index 114 to identify resources that are relevant to the search query 116. The search system 112 identifies the resources in the form of search results 118 and returns the search results 118 to the user devices 106 in search results pages. A search result 118 is data generated by the search system 112 that identifies a resource that is responsive to a particular search query, and includes a link to the resource. An example search result 118 can include a web page title, a snippet of text or a portion of an image extracted from the web page, and the URL of the web page. Search results pages can also include one or more advertisement slots in which advertisements can be presented.

When a resource 105 or search results 118 are requested by a user device 106, the advertisement management system 110 receives a request for advertisements to be provided with the resource 105 or search results 118. The request for advertisements can include characteristics of the advertisement slots that are defined for the requested resource or search results page, and can be provided to the advertisement management system 110. For example, a reference (e.g., URL) to the resource (e.g., a retailer's web page or a web page for a sports network) for which the advertisement slot is defined, a size of the advertisement slot, and/or media types that are available for presentation in the advertisement slot can be provided to the advertisement management system 110. Similarly, keywords associated with a requested resource ("resource keywords") or a search query 116 for which search results are requested can also be provided to the advertisement management system 110 to facilitate identification of advertisements that are relevant to the resource or search query 116.

Based on data included in the request for advertisements, the advertisement management system 110 can select advertisements that are eligible to be provided in response to the request ("eligible advertisements"). For example, eligible advertisements can include advertisements having characteristics matching the characteristics of advertisement slots and that are identified as relevant to specified resource keywords or search queries 116. In some implementations, advertisements having targeting keywords that match the resource keywords or the search query 116 are selected as eligible advertisements by the advertisement management system 110.

A targeting keyword can match a resource keyword or a search query 116 by having the same textual content ("text") as the resource keyword or search query 116. The relevance can be based on root stemming, semantic matching, and topic matching. For example, an advertisement associated with the targeting keyword "hockey" can be an eligible advertisement for an advertisement request including the resource keyword "hockey." Similarly, the advertisement can be selected as an eligible advertisement for an advertisement request including the search query "hockey."

A targeting keyword can also match a resource keyword or a search query 116 by having text that is identified as being relevant to a targeting keyword or search query 116 despite having different text than the targeting keyword. For example, an advertisement having the targeting keyword "hockey" may also be selected as an eligible advertisement for an advertisement request including a resource keyword or search query for "sports" because hockey is a type of sport, and therefore, is likely to be relevant to the term "sports."

Targeting keywords and other data associated with the distribution of advertisements can be stored in an advertising data store 119. The advertising data store 119 is a data store that stores associations of advertisements, advertising campaign parameters that are used to control distribution of the advertisements, data representing conditions under which the advertisement was selected for presentation to a user, and data representing actions taken by users in response to presentation of the advertisement.

For example, the advertising data store 119 can store targeting keywords, bids, and other criteria with which eligible advertisements are selected for presentation. The advertising data store 119 can also store data specifying targeting keywords that caused presentation of the advertisement (e.g., that matched a resource keyword or search query), ad slots in which the advertisement appeared, characteristics (e.g., locations and sizes) of the ad slots, and any special features that might have been applied to the advertisement.

Example features that can be applied to an advertisement include the being presented with an image, the advertisement being presented with (e.g., adjacent to) multiple links (e.g., hypertext links) to different landing pages for the advertiser, or the advertisement being provided with a link that, in response to selection of the link, causes the advertisement to expand and revealing additional information associated with the advertisement (e.g., revealing a map, presenting a video clip, or providing product purchasing information).

The advertising data store 119 can also store user interaction data specifying user interactions with presented advertisements (or other content items). For example, when an advertisement is presented to the user, data can be stored in the advertisement data store 119 representing the advertisement impression. In some implementations, the data is stored in response to a request for the advertisement that is presented. For example, the ad request can include data identifying a particular cookie, such that data identifying the cookie can be stored in association with data that identifies the advertisement(s) that were presented in response to the request.

When a user selects (i.e., clicks) a presented advertisement, data is stored in the advertisement data store 119 representing the user selection of the advertisement. In some implementations, the data is stored in response to a request for a web page that is linked to by the advertisement. For example, the user selection of the advertisement can initiate a request for presentation of a web page that is provided by (or for) the advertiser. The request can include data identifying the particular cookie for the user device, and this data can be stored in the advertisement data store.

In some implementations, user interaction data that are stored in the advertising data store 119 are anonymized to protect the identity of the user with which the user interaction data is associated. For example, user identifiers can be removed from the user interaction data. Alternatively, the user interaction data can be associated with a hash value of the user identifier to anonymize the user identifier. In some implementations, user interaction data are only stored for users that opt-in to having user interaction data stored. For example, a user can be provided an opt-in/opt-out user interface that allows the user to specify whether they approve storage of data representing their interactions with content.

The advertisement management system 110 can select the eligible advertisements that are provided for presentation in advertisement slots of a resource (e.g., a retailer's web page) or search results page based on results of an auction. For example, the advertisement management system 110 can receive bids for advertisers and allocate the advertisement slots to the auction winners at the conclusion of the auction. The bids are amounts (e.g., maximum prices) that the advertisers will pay for presentation (or selection) of their advertisement with a resource or search results page. For example, a bid can specify an amount that an advertiser will to pay for each 1000 impressions (i.e., presentations) of the advertisement, referred to as a CPM bid. Alternatively, the bid can specify an amount that the advertiser is willing to pay for user selection (i.e., a click-through) of the advertisement or a "conversion" (e.g., when a user performs a particular action related to an advertisement provided with a resource or search results page) following selection of the advertisement.

The auction winners can be determined based on "auction scores." An auction score is a value based, in part, on a bid and from which advertisements are selected for presentation. In some implementations, each auction score can represent a bid, or a product of the bid and one or more factors, such as a quality score associated with the advertiser. For example, the quality score can be an advertiser quality score that can be derived from one or more of advertisement performance, advertisement content quality factors (e.g., color, animation, and other aspects of the advertisement's appearance), and/or landing page scores.

For example, assume that the auction score is a product of the bid specified by the advertiser and a quality score for the advertiser (i.e., auction score=bid*advertiser quality score). Further assume that advertiser A selects a $1.00 cost per click bid ("CPC" bid) and has a quality score of 5.0, while advertiser B selects a $0.80 CPC bid and has a quality score of 9.0. In this example, Advertiser A will have an auction score of 5.0, while advertiser B will have an auction score of 7.2. Thus, advertiser B will be the auction winner in this example, even though advertiser A submitted the higher CPC bid.

The auction score for a co-sponsored advertisement can be computed, for example, using a total bid provided by the advertisers that provided content for the co-sponsored advertisement and/or an aggregate quality score for the advertisers. The aggregate quality score can be for example a mean quality score, a selection of a highest or lowest quality score for the advertisers, or another statistical measure of the quality scores for the advertisers.

In some implementations, the advertiser quality score can be specified on a per-targeting-keyword basis. For example, a particular advertiser may target one set of advertisements using the targeting keyword "hockey" while targeting another set of advertisements using the targeting keyword "soccer." The advertiser may have a quality score of 6.0 for the targeting keyword "hockey," while having a quality score of 8.0 for the targeting keyword "soccer." In this example, if the advertiser bids $1.00 CPC for each of the targeting keywords, the advertiser will have an auction score of 6.0 for the targeting keyword "hockey" and an auction score of 8.0 for the targeting keyword "soccer."

As described above, advertisers 108 can submit, to the advertisement management system 110, campaign parameters (e.g., targeting keywords and corresponding bids) that are used to control distribution of advertisements. Campaign parameters are parameters corresponding to a content distribution campaign that are used to control content selection in response to content requests. For example, campaign parameters can include targeting keywords and corresponding bids, geographic or demographic targeting criteria, as well as other parameters corresponding to a set of advertisements. A campaign is a set of one or more advertisements and corresponding campaign parameters that are grouped together into a same advertising unit. For example, advertisements for sporting equipment can be grouped together into a campaign.

Within a campaign, subsets of the advertisements can be grouped into "ad groups." For example, an ad group in the above-referenced sports equipment campaign can include a set of advertisements that are each directed to baseball equipment. The campaign parameters corresponding to each ad group can be referred to as ad group parameters and, because ad group parameters are a subset of campaign parameters, changes to ad group parameters constitute changes to campaign parameters.

The advertisers 108 can also access to the advertisement management system 110 to monitor performance measures for the advertisements that are distributed using the campaign parameters. For example, an advertiser can access a campaign performance report that provides quantities of impressions (i.e., presentations), user selections (i.e., clicks), and conversions that have been identified for the advertisements. The campaign performance report can also provide a total cost, a cost-per-click, and other cost measures for the advertisement over a specified period of time. The content performance report can delineate the performance measures for the advertisements on a per-targeting-keyword basis so that the advertiser can compare the performance measures for advertisements associated with different targeting keywords.

In order to decrease advertising costs and/or increase the effectiveness of advertising campaigns, advertisers may wish to distribute co-sponsored advertisements (or other content items). For example, a small business (or any content distributor) may be willing to allow another advertiser, such as a supplier, to include content in the advertisement being distributed by the small business in order to reduce advertising costs. Similarly, a large business (or another content distributor) may be willing to pay to have a brand logo, sponsorship message, and/or other content included in an advertisement with content provided by another advertiser, thereby increasing exposure to their brand without requiring the large business to pay for a full advertisement slot on a web page. In this example, the small business and large business can both achieve their goals by distributing a co-sponsored advertisement that includes content provided by each of the small business and the large business, where the cost of the co-sponsored advertisement is apportioned between the two businesses.

Figure 2:
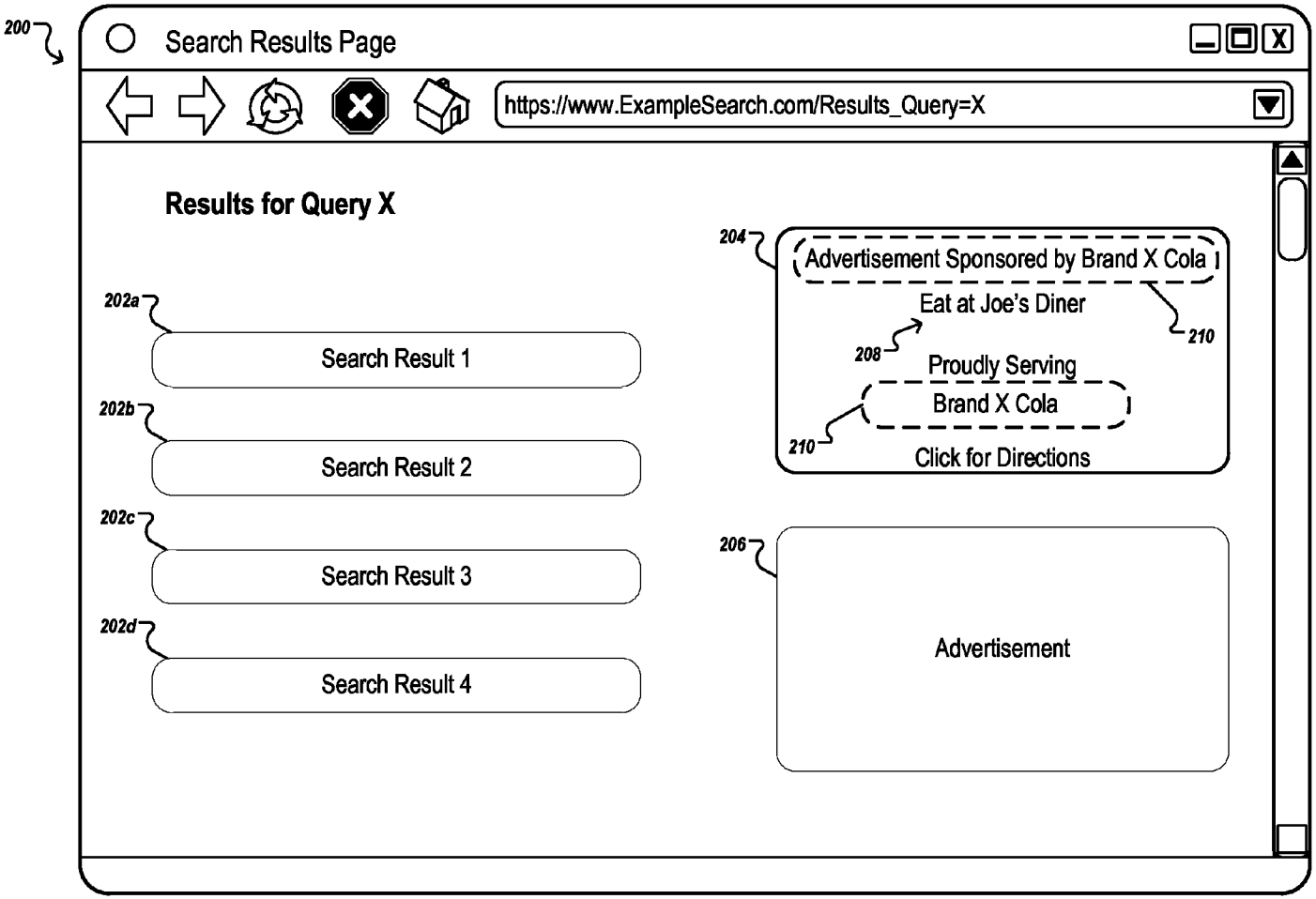
FIG. 2 is a screen shot of an example search results page in which a co-sponsored advertisement is presented.

FIG. 2 is a screen shot of an example search results page 200 in which a co-sponsored advertisement 204 is presented.

The search results page 200 is used for purposes of example. As noted above, co-sponsored advertisements can also be presented on web pages that are not search results pages, such as a retailer's web page, a news web page, or a blog.

The search results page 200 includes search results 202*a*-20*d* responsive to search query "X," the co-sponsored advertisement 204 that is presented in an individual advertisement slot of the search results page 200, and another advertisement 206 that is presented in another individual advertisement slot of the search results page 200. The co-sponsored advertisement 204 includes content that is provided by two different advertisers. For example, the co-sponsored advertisement 204 includes content 208 provided by a first advertiser (e.g., Joe's Diner) as well as content 210 provided by a second advertiser (e.g., Brand X Cola). As described in more detail below, the content that is included in the co-sponsored advertisement 204 can be selected based by an advertiser and/or based on co-sponsor preferences of one or more of the advertisers (e.g., Joe's Diner and/or Brand X Cola).

Each of the co-sponsored advertisement 204 can reference one or more resource locations (e.g., URLs). For example, a URL of a web page for Joe's Diner can be associated with the content 208 that was provided by Joe's Diner, while a URL for a web page for Brand X Cola can be associated with the content 210 that was provided by Brand X Cola. In this example, when a user selects (i.e., clicks) the content 208 provided by Joe's Diner a request for the web page for Joe's Diner can be initiated, while a request for the web page for Brand X Cola can be initiated when the user selects the content 210 that was provided by Brand X Cola (e.g., clicks within an image area within the outline referenced by 210). References to resources can also be associated with the content in other ways. For example, a single URL that references a web page for Joe's Diner (or Brand X Cola) can be associated with the entire co-sponsored advertisement 204. In this example, a click on any portion of the co-selected advertisement will initiate a request for the web page referenced by the URL.

Typically, when a particular advertiser wants to co-sponsor an advertisement with another advertiser, that particular advertiser must seek out the other advertiser, negotiate a co-sponsorship agreement, and the two advertisers will then create an advertisement that includes content from each advertiser. However, this process can be difficult, time consuming, and costly. The effort, time, and cost associated with entering the typical co-sponsorship agreements reduces the ability for many advertisers to enter into a typical co-sponsorship agreement.

Referring again to FIG. 1, the advertisement management system 110 includes, or is in communication with, a co-sponsored advertisement apparatus (CAA) 120 that facilitates creation and distribution of co-sponsored advertisements. In some implementations, the CAA 120 receives, for multiple different advertisers, data specifying advertisement content, bids that are respectively associated with the advertisement content, and/or co-sponsor preferences that are respectively associated with the advertisement content. Using the received data, the CAA 120 computes a total bid (and/or a total quality score) for co-sponsored advertisements that can be created using the advertisement content. When a request for an advertisement (or another content item request) is received the total bids (and/or total quality scores) can be used to perform an auction, for example, by the advertisement management system 110 or another data processing apparatus. Using the results of the auction, the CAA 120 selects advertisement content that is associated with winning total bids, and creates a co-sponsored advertisement using the selected advertising content. The CAA 120 then provides, in response to the request, the co-sponsored advertisement for presentation in an advertisement slot.

In some implementations, co-sponsored advertisements can be created by inserting advertising content from two or more advertisers into a content template that has been selected as a template for the co-sponsored advertisement. A template for a co-sponsored advertisement can be selected and/or created, for example, by an advertiser that is willing to include advertising content of other advertisers with its advertisement. Alternatively, the advertiser that selects the template can be the advertiser that provides a larger portion of the total content that will be presented in the co-selected advertisement.

Each advertiser that provides content for inclusion in a co-sponsored advertisement can also provide and/or specify a template for their content. Each advertiser can also specify whether their content must be included in the template that they provided, or whether their content can also be inserted into other templates. When an advertiser specifies that their content only be included in the template that the advertiser provided, the advertiser's content will not be selected for inclusion in a co-sponsored advertisement that is created using another template. In situations where two advertisers have provided a template for their content, but each advertiser has authorized presentation of their respective content in other templates, the selected template can be, for example, the template provided by the advertiser that provides the larger bid and/or the advertiser that provides the larger portion of content.

In some implementations, partially populated templates can be used to facilitate creation of co-sponsored advertisements. For example, a template can be selected or created by one advertiser, partially populated with advertising content provided by that advertiser, and the partially populated template can be made available for review by other advertisers that are searching for advertisements to co-sponsor, as described in more detail below. When templates are selected or created by an advertiser or another user, the CAA 120 receives data specifying the selected template, and can populate the template with advertising content that is selected to be included in a co-sponsored advertisement.

Figure 3:
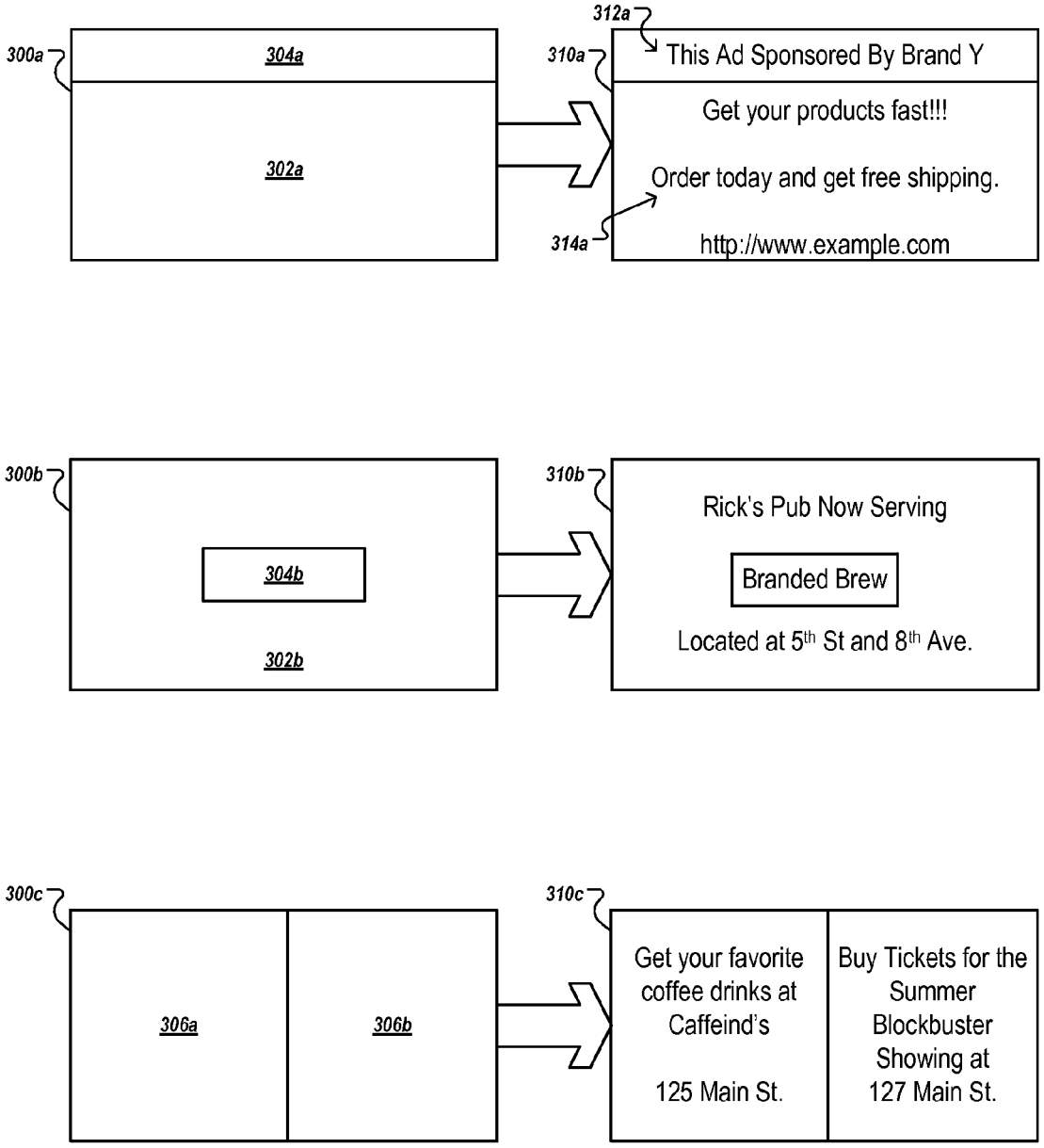
FIG. 3 is an illustration of example templates that can be used to create a co-sponsored advertisement.

FIG. 3 is an illustration of example templates 300*a*-300*c* that can be used to create a co-sponsored advertisement. Each of the templates 300*a*-300*c* can be populated with advertising content from two different advertisers to create co-sponsored advertisements 310*a*-310*c*. For example, in templates 300*a* and 300*b*, one advertiser can provide advertisement content that is presented in a primary portion 302*a* or 302*b* of the templates 300*a* or 300*b*, while another advertiser can provide advertisement content that is presented in a secondary portion 304*a* or 304*b* of the templates 300*a* or 300*b*. In template 300*c*, two advertisers (in this example neighboring businesses) can provide an approximately equal portion of advertising content for presentation in two approximately equally sized portions 306*a* and 306*b* of the template 300*c* to create the co-sponsored advertisement 310*c*.

A primary portion 302 is a portion of a template 300 in which primary advertisement content is presented. The primary advertisement content can be, for example, the advertisement content that will occupy a largest portion of the co-selected advertisement created using a template 300, advertisement content associated with a highest bid (among bids that were received for a particular co-sponsored advertisement), or advertisement content provided by an advertiser that originally selected and/or created the template 300.

A secondary portion 304 is a portion of a template 300 in which secondary advertisement content is presented. The secondary advertisement content can be, for example, advertisement content that occupies a smaller portion (relative to the primary advertisement content) of the co-selected advertisement 310 that is created using a template 300, advertisement content associated with a lowest bid, or advertisement content provided by an advertiser for inclusion in a template 300 that was selected by another advertiser.

Template 300*a* can be used, for example, to create co-sponsored advertisement 310*a*. In co-sponsored advertisement 310*a*, the primary content 312*a* is the text that appears at a location of the co-sponsored advertisement corresponds to the primary portion 302*a* of template 300*a*. The secondary content 314*a* of co-sponsored advertisement 310*a* is the text that appears at a location corresponding to the secondary portion 304*a* of the template 300*a*.

In this example, the primary content 312*a* can be text that was provided by an advertiser that selected the template. For example, the advertiser that provided the primary content 312*a* may have selected the template 300*a* from a set of available templates and provided advertisement content including the primary content 312*a* for inclusion in the template 300*a*. In response to receiving data specifying the selection of template 300*a* and the advertisement content, the CAA 120 stores the primary content 312*a* as content to be inserted into the primary portion 302*a* of the template 300*a*.

The secondary content 314*a* used by the CAA 120 to create the co-sponsored advertisement 310*a* is advertisement content associated with a different advertiser from the advertiser that provided the primary content 312*a*. In some implementations, the secondary content 314*a* can be selected for inclusion in the co-selected advertisement 310*a* by the advertiser that selected the template 300*a* (e.g., from a set of available secondary content for the co-sponsored advertisement), by the advertiser that uploaded the primary content 312*a*, and/or by an automated process performed by the CAA 120.

In other implementations, advertisers from which secondary content 314 is received can specify that the secondary content 314 be presented with a particular partially populated template (i.e., a template that has been populated with particular primary content). In these implementations, the CAA 120 can provide data that make the partially populated template available for inspection by advertisers that are interested in co-sponsoring an advertisement.

For example, the data provided by the CAA 120 can cause the partially populated template to be presented to an advertiser in response to a request to view the partially populated template. In turn, the advertiser can submit advertisement content and an associated bid to the CAA 120 (or advertisement management system 110) with a co-sponsor request (i.e., a request that the advertisement content be presented in a co-sponsored advertisement) requesting that advertisement content be included in a co-sponsored advertisement created using the partially populated template. In response to receiving the co-sponsor request, the CAA 120 can store the received advertisement content as secondary content for the partially populated template.

Each pair of primary content and secondary content that is stored with reference to a particular template defines an available co-sponsored advertisement that can be selected for distribution using a set of targeting keywords and/or a total bid that is associated with the available co-sponsored advertisement. The CAA 120 computes the total bid for each available co-sponsored advertisement using bids that are associated with the primary content and the secondary content for the available co-sponsored advertisement. For example, the total bid can be a mathematical sum of the respective bids for the primary content and secondary content or another function of the bids (e.g., a weighted sum of bids using quality scores and/or other attributes associated with the respective content as the weights).

When two or more advertisers have provided secondary content for inclusion in a co-sponsored advertisement with the same primary content, the CAA 120 can compute a total bid for each combination of primary content and secondary content that can be used to create a co-sponsored advertisement. Alternatively, the CAA 120 can select a particular pair of primary and secondary content and compute a single total bid for the co-sponsored advertisement that is created using the selected pair. For example, the CAA 120 can select the secondary content that is associated with a highest bid and/or a highest quality score, and compute a single total bid using the bid for the primary content and the bid for the selected secondary content. The total bids can be stored in a data store (e.g., advertising data store 119) and indexed according to the co-sponsored advertisements.

The targeting keywords for a co-sponsored advertisement can be specified, for example, by the advertiser that provided the primary content, the advertiser that selected the template, the advertiser that provided the secondary content, and or a combination of the targeting keywords provided by the advertisers (e.g., a union of targeting keywords specified by each of the advertisers that provide advertising content for a particular co-sponsored advertisement). The targeting keywords can be stored and indexed according to the co-sponsored advertisement, for example, in a data store such as the advertising data store 119 of FIG. 1.

When an advertisement request is received that includes a resource keyword and/or a search query that matches a targeting keyword for a particular co-sponsored advertisement, the CAA 120 can provide the total bid for the particular co-sponsored advertisement to a data processing apparatus that performs an auction using the total bid for the particular co-sponsored advertisement and other bids that are associated with other advertisements that are responsive to the advertisement request. In turn, advertisements are provided in response to the advertisement request based on the results of the auction. For example, if the particular co-sponsored advertisement is associated with a winning bid, the CAA 120 and/or advertisement management system 110 provides data that causes presentation of the co-sponsored advertisement at a user device for which the advertisement request was received.

Figure 5:
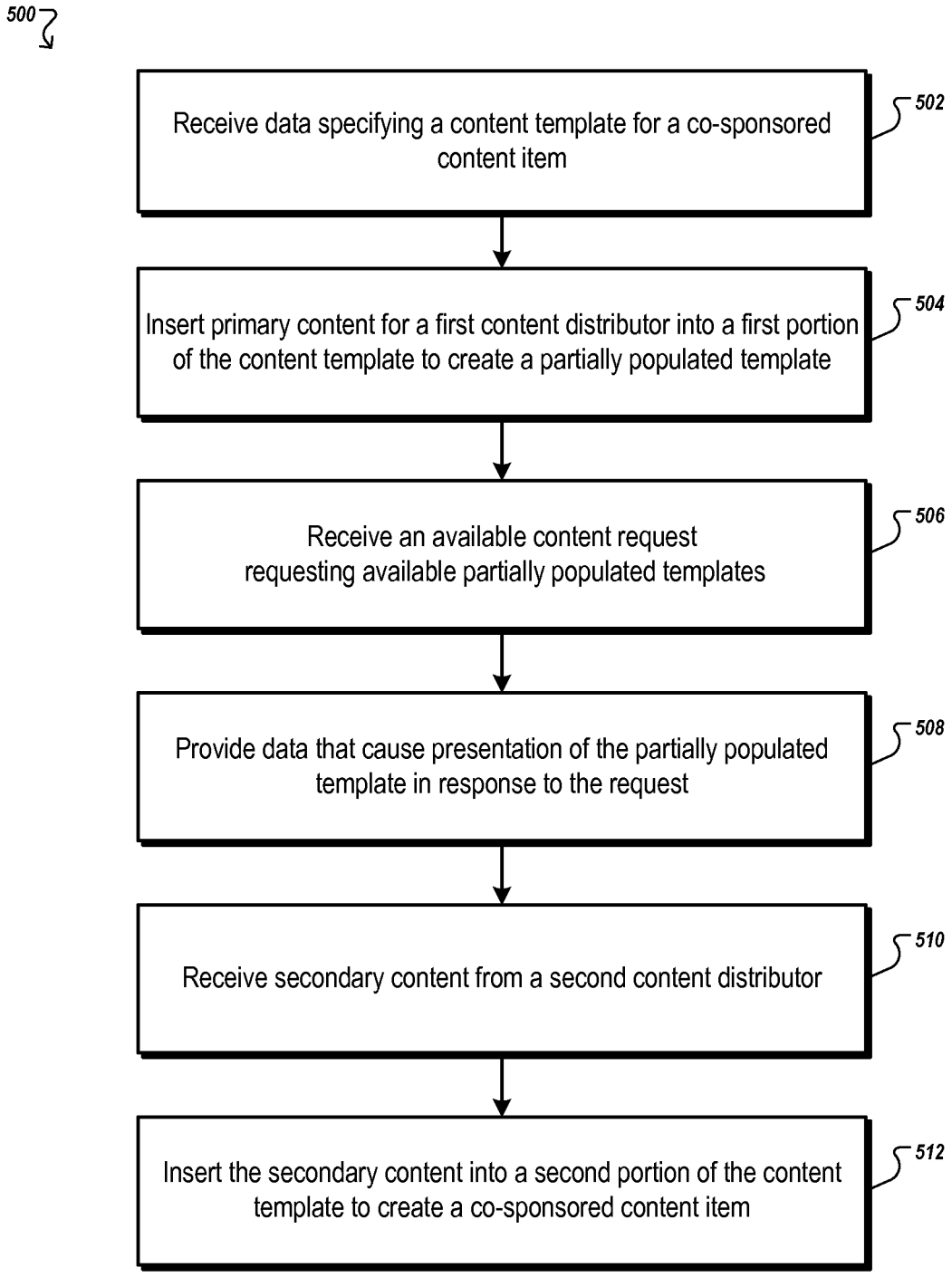
FIG. 5 is a flow chart of an example process for creating a co-sponsored content item.
Figure 6:
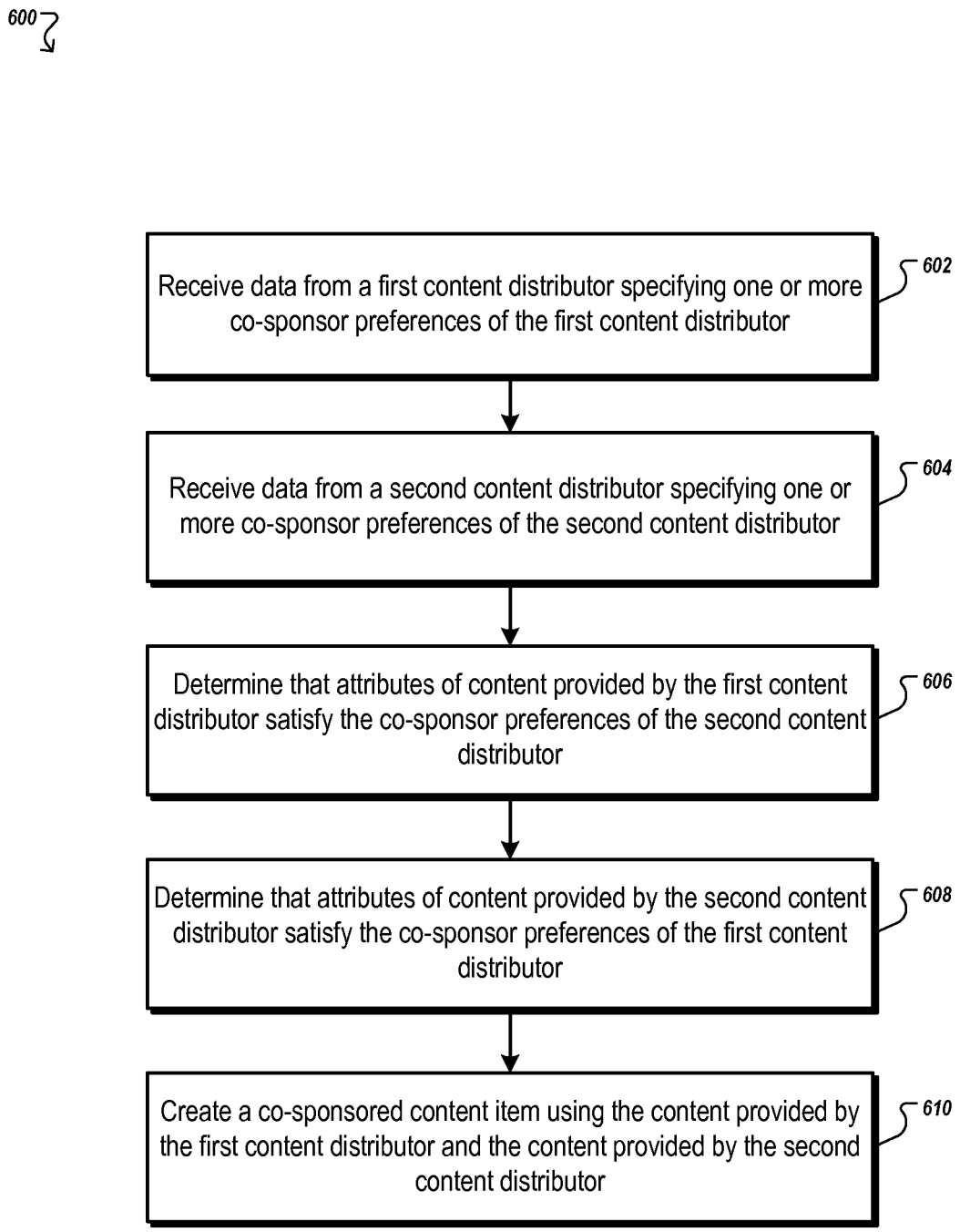
FIG. 6 is a flow chart of another example process for creating a co-sponsored content item.

The description that follows discusses processes that can be performed to facilitate creation and distribution of co-sponsored content items, such as co-sponsored advertisements. For example, a process for providing a co-sponsored content item in response to a request for a content item is described with reference to FIG. 4, while the description of FIGS. 5 and 6 provide processes for creating co-sponsored content items. Finally, a data processing apparatus that can be used to facilitate creation and distribution of co-sponsored content items is described with reference to FIG. 7.

Figure 4:
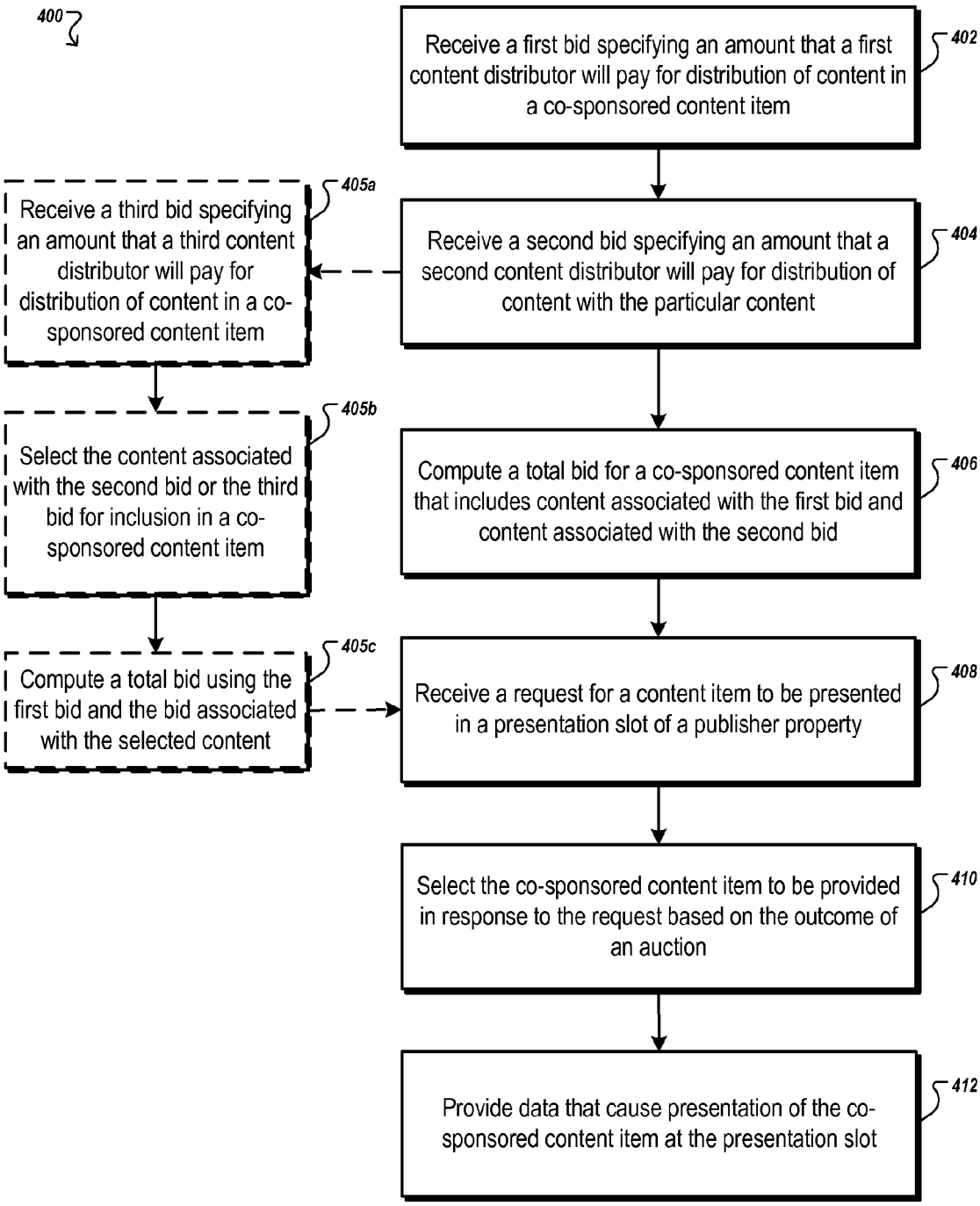
FIG. 4 is a flow chart of an example process for distributing co-sponsored content items.

FIG. 4 is a flow chart of an example process 400 for distributing co-sponsored content items. The process 400 is a process by which bids are received from a set of content distributors. The bids specify an amount that content distributors will respectively pay for distribution of specified content in a co-sponsored advertisement. Using the bids, total bids for co-sponsored content items that include content from two or more content distributors are computed. In response to receiving a request for a content item and using results of an auction, a co-sponsored content item that is associated with a winning bid is selected to be provided. In turn, data that cause presentation of the selected co-sponsored content item are provided.

The process 400 is described below with reference to co-sponsored advertisements that are distributed in an online environment. The process 400 can also be used to facilitate distribution of other co-sponsored content items (e.g., video, audio, game, or other content). The process 400 can be implemented, for example, using the CAA 120 and/or advertisement management system 110 of FIG. 1. The process can also be implemented instructions stored on computer storage medium such that execution of the instructions by data processing apparatus cause the data processing apparatus to perform the operations of the process 400.

A first bid specifying an amount that a first content distributor will pay for distribution of content in a co-sponsored content item is received (402). In some implementations, the first bid is a bid received from an advertiser and specifies a maximum amount that the advertiser will pay for distribution of advertising content in a co-sponsored advertisement. The advertising content can be all of an advertisement or a portion (less than all) of an advertisement for the first advertiser. For example, the advertising content can include text, images, audio, video or other content that can be included in an advertisement. The first bid can be received with the advertising content with which the bid is associated, or the first bid can be received prior to, or following, receipt of the advertising content with which the bid is associated.

In some implementations, the first bid can be a bid that is unconditionally valid. In these implementations, the first bid can be used for distributing content in any co-sponsored advertisement irrespective of other advertising content that is included in the co-sponsored advertisement. In other implementations, the first bid can be conditionally valid, where the validity of the bid is dependent on co-sponsor preferences associated with the first bid. The co-sponsor preferences can include, for example, at least one of: presentation attributes (i.e., audio or graphical attributes) of other advertising content being included in the co-sponsored advertisement, bids for other advertising content in the co-sponsored advertisement summing to at least a minimum value, and/or targeting keywords that are associated with the other advertising content being included in the co-sponsored advertisement.

For example, assume that a bid for Advertiser A has a value of $1.00/click and is associated with advertising content for a diner that is targeted using the keywords "diner," "Atlanta," and "coffee." In this example, Advertiser A may wish to limit the advertising content that can potentially be presented with Advertiser A's advertising content. Therefore, advertiser A may provide a co-sponsor preference specifying that its bid is only valid for co-sponsored advertisements including advertising content that is associated with the targeting keyword "Atlanta." Advertiser A may also provide a co-sponsor preference specifying that its bid is only valid when the bid associated with other advertising content in the co-sponsored advertisement is at least equal to $0.50. Upon receipt of these co-sponsor preferences, the validity of Advertiser A's bid can be conditioned on the satisfaction of Advertiser A's co-sponsor preferences.

A second bid specifying an amount that a second content distributor will pay for distribution of content in a co-sponsored content item is received (404). The second bid can be a bid that is received from another advertiser (different than the advertiser associated with the first bid) and specifies a maximum amount that the advertiser will pay for distribution of advertising content in a co-sponsored advertisement. The second bid can be an amount that the other advertiser will pay for distribution of the advertising content in a co-sponsored advertisement with any other content. Alternatively, the second bid can be associated with co-sponsor preferences specifying that the second bid is only valid for distributing the content in a same co-sponsored advertisement as the advertising content that is associated with the first bid, advertising content provided by a particular advertiser, and/or advertising content that satisfies co-sponsor preferences associated with the second bid.

In some implementations, the first bid, second bid, or any other bid can be a null bid (i.e., having a value of zero), or a negative bid (i.e., a bid having a negative value). When a content distributor specifies a null bid, the content is available for inclusion in a co-sponsored content item, but the content distributor will not pay for distribution of the co-sponsored content item.

When a content distributor specifies a negative bid, content provided by the content distributor is available for distribution in a co-sponsored content item, but the content distributor requires compensation for the use of its content in a co-sponsored content item. A negative bid may be provided, for example, by a particular content distributor that provides content that substantially increases a number of purchases for other content providers that co-sponsor content items with the particular content distributor. For example, the increased value of including the content from the particular content distributor may enable the particular content distributor to receive compensation for allowing its content to be included in co-sponsored content items.

A total bid for a co-sponsored content item that includes content associated with the first bid and content associated with the second bid is computed (406). In some implementations, the total bid is computed as a sum of the bids that are associated with advertising content that is to be included in a co-sponsored advertisement. For example, assume that one advertiser has bid $1.00 to have its advertising content included in a co-sponsored advertisement, and that another advertiser has bid $0.75 to have its advertising content included in the co-sponsored advertisement. In this example, the total bid for the co-sponsored advertisement that includes the advertising content associated with both bids is $1.75.

Other functions of bids can also be used to compute a total bid for a co-sponsored content item. In some implementations, the total bid can be a weighted sum of the bids where each bid is weighted according to a relative portion (e.g., percentage) of the total area of the co-sponsored content item that is occupied by the content associated with the bid. Continuing with the example above, the advertiser that submitted the bid of $1.00 may further specify that its maximum bid be adjusted in proportion to the portion (e.g., bid*percentage) of the co-sponsored content item that is occupied by the advertiser's content, while the other advertiser may specify that its bid of $0.75 is valid as long as its advertisement occupies at least 10% of the co-sponsored content item. In this example, the total bid for the co-sponsored content item will be $1.65 (i.e., (90%*$1.00)+$0.75) when the advertisement associated with the $1.00 bid is allocated 90% of the co-sponsored content item and the advertisement associated with the $0.90 bid is allocated 10% of the co-sponsored advertisement. Advertisers can also specify their bids in terms of the portion of the co-sponsored content item occupied by their advertisement. For example, an advertiser can agree to pay $0.01 for each percentage of the co-sponsored content item that is occupied by the advertiser's content.

In some implementations, a third bid specifying an amount that a third content distributor will pay for distribution of content in a co-sponsored content item is optionally received (405*a*). The third bid can be a bid specifying an amount that another content distributor will pay to have its content distributed in a co-sponsored content item with the content associated with the first bid. For example, assume that a third advertiser is interested in co-sponsoring an advertisement with the first advertiser described above. However, if only one advertiser can co-sponsor an advertisement with the first advertiser, then advertisement content provided by only one of the second and third advertiser will be included in the co-sponsored advertisement with the advertisement content provided by the first advertiser.

In these implementations, content associated with the second bid or the third bid is selected for inclusion in a co-sponsored content item (405*b*). The content that will be included can be selected, for example, based on the outcome of an auction using the second bid and the third bid. For example, the content that is associated with a highest auction score (e.g., a highest bid or a highest value resulting from a function of the bid and other factors such as quality score) can be selected as the content to be included in the co-sponsored content item with the content associated with the first bid.

Once the content that will be included in the co-sponsored advertisement has been selected, a total bid using the first bid and the bid associated with the selected content can be computed (405*c*). As described above, the total bid can be computed as a sum of the first bid and the bid associated with the selected content, or based on a function of the respective bids and/or other factors.

A request is received for a content item to be presented in a presentation slot of a publisher property (408). The presentation slot can be, for example, an advertisement slot in which advertisements are presented with a publisher web page. The presentation slot can also be a portion of a publisher's web page in which third party content items (e.g., games, audio, video) are presented.

In response to the request, the co-sponsored content item is selected to be provided based on the outcome of an auction (410). In some implementations, the auction is performed using the total bid for the co-sponsored content item and a plurality of other bids for other content items. The auction can be, for example, a generalized second price auction, first price auction, or another auction type. The results of the auction can specify winning bids and/or content items that are associated with the winning bids.

Data are provided that cause presentation of the co-sponsored content item at the presentation slot (412). For example, data that cause presentation of the co-sponsored content item can be provided to a user device for which the request for a content item was submitted.

FIG. 5 is a flow chart of an example process 500 for creating a co-sponsored content item. The process 500 is a process by which data specifying a content template for a co-sponsored content item are received, and primary content for a first content distributor is inserted into a portion of the content template to create a partially populated template. A request for available partially populated templates is received, and data that cause presentation of the partially populated template are provided. Secondary content is received from a second content distributor and the secondary content is inserted into a second portion of the content template to create a co-sponsored content item.

The process 500 is described below with reference to creating co-sponsored advertisements that are distributed in an online environment. The process 500 can also be used to create other co-sponsored content items (e.g., video, audio, game, or other content). The process 500 can be implemented, for example, using the CAA 120 and/or advertisement management system 110 of FIG. 1. The process can also be implemented instructions stored on computer storage medium such that execution of the instructions by data processing apparatus cause the data processing apparatus to perform the operations of the process 500.

Data specifying a content template for a co-sponsored content item are received (502). In some implementations, the content template specifies portions of the co-sponsored content item in which primary content and secondary content are presented, as described above with reference to FIG. 3. The data specifying the content template can be received, for example, in response to selection of a template by an advertiser (e.g., from a set of available templates), or in response to the advertiser providing (e.g., uploading) the template (or a partially populated template) through a user interface.

Primary content for a first content distributor is inserted into a first portion of the content template to create a partially populated template (504). In some implementations, the primary content is inserted into the template by storing the primary content in association with data that specifies that the primary content be presented at the location of the first portion when the co-sponsored content item, or the partially populated template, is presented.

For example, a reference to the first portion of the content template (e.g., the primary portion 304*a* of FIG. 3) can be stored with, or appended to, the primary content. When the primary content is provided for presentation, the reference to the first portion can cause the primary content to be presented at a location of the first portion of the content template.

An available content request is received that requests available partially populated templates (506). In some implementations, the request is received form an advertiser that is searching for advertisements or other content to co-sponsor. For example, assume that LargeCo is a large beverage company that is interested in co-sponsoring advertisements for restaurants and other businesses that sell LargeCo beverages. In this example, the LargeCo may be provided a user interface that enables it to search for advertisements to co-sponsor. LargeCo may submit as a search query, or select from user interface menus, co-sponsor preferences (e.g., company names, product categories, targeting keywords) to find advertisements that LargeCo is interested in sponsoring.

The co-sponsor preferences are used to select one or more partially populated templates that include content having attributes that match the co-sponsor preferences. For example, if the co-sponsor preferences include the targeting keyword "diner," partially populated templates that are associated with primary content targeted using the keyword "diner" can be selected as responsive to the request. As described above with reference to FIG. 1, a match does not necessarily require that attributes of content be the same as the co-sponsor preferences.

Data are provided that cause presentation of the partially populated template in response to the request (508). In some implementations, the data that cause presentation of the partially populated template can be data that provide a list of available partially populated templates that match the received co-sponsor preferences. In other implementations, the data can cause presentation of a co-sponsored advertisement according to the partially populated template. For example, the data can cause presentation of the primary content as it will appear in the co-sponsored advertisement and also cause presentation of placeholders identifying the locations at which a co-sponsor can insert advertisement content.

Secondary content is received from a second content distributor (510). In some implementations, the secondary content is received with data specifying a partially populated template in which the secondary content is to be inserted. For example, in response to selecting a partially populated template from the available partially populated templates, an advertiser can be requested to upload or select the advertising content that is to be presented in the selected template. In response to the request, the advertiser can upload, select, or otherwise specify a location (e.g., a URL) of the secondary content.

The secondary content is inserted into a second portion of the content template to create a co-sponsored content item (512). As described above, in some implementations, the secondary content is inserted into the template by storing the secondary content in association with data that specifies that the secondary content be presented at a location of the secondary portion when the co-sponsored content item or the partially populated template is presented. In other implementations, a separate file with the formatting information can be stored for each template for which the advertising data is available to be inserted. Once the secondary content is inserted into the template, the primary content and the secondary content can be provided for presentation as the co-sponsored content item in response to a request for a content item.

FIG. 6 is a flow chart of another example process 600 for creating a co-sponsored content item. The process 600 is a process by which data specifying co-sponsor preferences are received from content distributors. Using the co-sponsor preferences a determination is made that content from a first content distributor matches co-sponsor preferences of a second content distributor, and that content from the second content distributor matches co-sponsor preferences of the first content distributor. In turn, a co-sponsored content item is created using the content provided by the first content distributor and the content provided by the second content distributor.

The process 600 is described below with reference to creating co-sponsored advertisements that are distributed in an online environment. The process 600 can also be used to create other co-sponsored content items (e.g., video, audio, game, or other content). The process 600 can be implemented, for example, using the CAA 120 and/or advertisement management system 110 of FIG. 1. The process can also be implemented instructions stored on computer storage medium such that execution of the instructions by data processing apparatus cause the data processing apparatus to perform the operations of the process 600.

Data are received that specify one or more co-sponsor preferences of a first content distributor (602). In some implementations, the one or more co-sponsor preferences of the first content distributor can specify one or more attributes that are used to select content to be presented in a co-sponsored content with content provided by the first content distributor. For example, the co-sponsor preferences of the first content distributor can specify targeting keywords, names of advertisers, categories of products, and other attributes that content should have for the content to be presented in a co-sponsored advertisement with content provided by the first content distributor.

Data are received that specify one or more co-sponsor preferences of a second content distributor (604). In some implementations, the one or more co-sponsor preferences of the second content distributor can specify one or more attributes that are used to select content to be presented in a co-sponsored content with content provided by the second content distributor. For example, the co-sponsor preferences of the second content distributor can specify targeting keywords, names of advertisers, categories of products, and other attributes that content should have for the content to be presented in a co-sponsored with content provided by the second content distributor.

It is determined that attributes of content provided by the first content distributor satisfy the co-sponsor preferences of the second content distributor (606). Additionally, it is determined that attributes of content provided by the second content distributor satisfy the co-sponsor preferences of the first content distributor (608). In some implementations, the co-sponsor preferences are satisfied when a minimum threshold level of match is determined to exist between the attributes of the content provided by the first content distributor and the co-sponsor preferences. For example, assume that advertiser A specifies the keyword "sports," as a co-sponsor preference and also specifies that "sports" can be matched by targeting keywords that are not exact matches. In this example the targeting keyword "football" can be considered to match the targeting keyword "sports" because football is a type of sport. Therefore, it can be determined that advertiser A's co-sponsor preferences are satisfied by the attributes of the content provided by advertiser B when the content provided by advertiser B is associated with the targeting keyword "football".

The threshold level of match can be specified, for example, as a minimum cosine similarity measure between the attributes and the co-sponsor preferences, or a minimum quantity of attributes that match and/or are the same as (i.e., exact matches with) the co-sponsor preferences. Other measures of similarity can also be used. In some implementations, the minimum level of match can be specified by each content distributor. For example, each content distributor can specify that at least a minimum quantity of their specified co-sponsor preferences be matched and/or exactly matched to be included in a co-sponsored content item. Additionally, each content distributor can specify the type of match (e.g., exact match or non-exact match) that is required for each co-sponsor preference.

For example, a particular advertiser may specify that its co-sponsor preference of the keyword "hockey" be matched exactly, and that this preference is the only preference that is required to be matched. In this example, content that is associated with the targeting keyword "hockey" will be the only content that is available content for creating a co-sponsored content item that includes the content provided by the particular advertiser.

A co-sponsored content item is created using the content provide by the first content distributor and the content provided by the second content distributor (610). In some implementations, the co-sponsored content item is created by inserting the content from each of the content providers into a content template, as described above. Once the co-sponsored content item has been created, it can be provided for presentation in response to a content item request, as described above.

Figure 7:
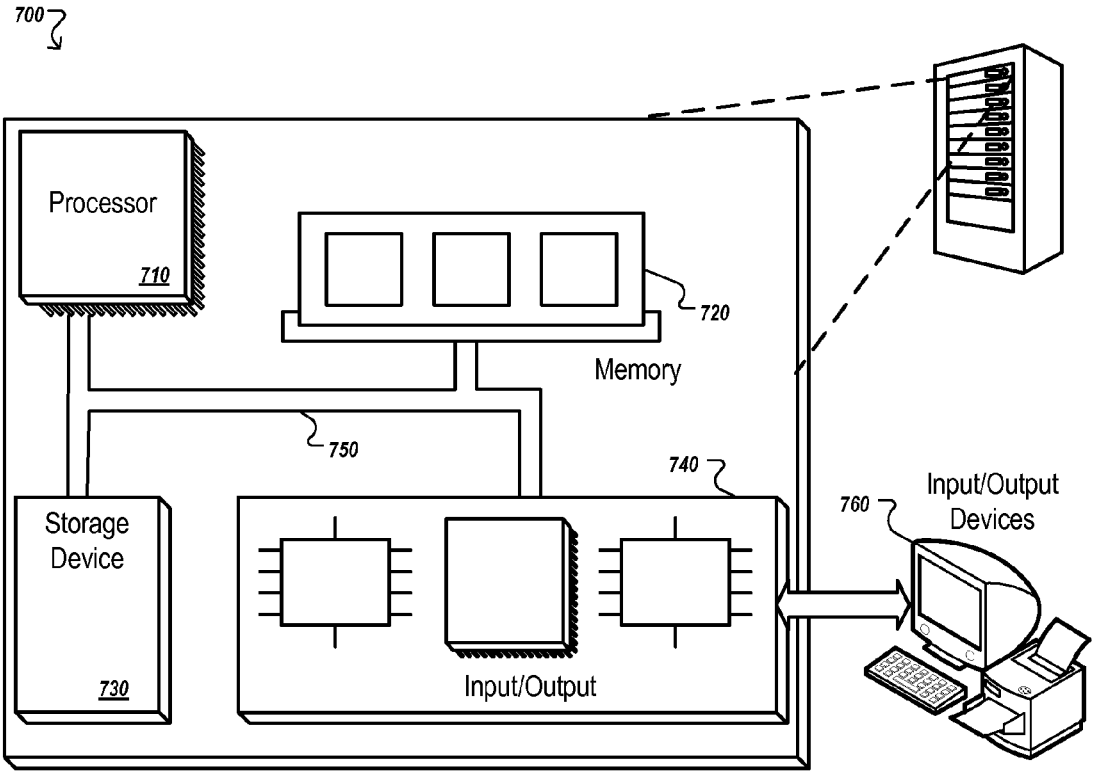
FIG. 7 is block diagram of an example computer system that can be used to create and/or distribute co-sponsored content items.

FIG. 7 is block diagram of an example computer system 700 that can be used to create and/or distribute co-sponsored content items. The system 700 includes a processor 710, a memory 720, a storage device 730, and an input/output device 740. Each of the components 710, 720, 730, and 740 can be interconnected, for example, using a system bus 750. The processor 710 is capable of processing instructions for execution within the system 700. In one implementation, the processor 710 is a single-threaded processor. In another implementation, the processor 710 is a multi-threaded processor. The processor 710 is capable of processing instructions stored in the memory 720 or on the storage device 730.

The memory 720 stores information within the system 700. In one implementation, the memory 720 is a computer-readable medium. In one implementation, the memory 720 is a volatile memory unit. In another implementation, the memory 720 is a non-volatile memory unit.

The storage device 730 is capable of providing mass storage for the system 700. In one implementation, the storage device 730 is a computer-readable medium. In various different implementations, the storage device 730 can include, for example, a hard disk device, an optical disk device, or some other large capacity storage device.

The input/output device 740 provides input/output operations for the system 700. In one implementation, the input/output device 740 can include one or more of a network interface devices, e.g., an Ethernet card, a serial communication device, e.g., and RS-232 port, and/or a wireless interface device, e.g., and 802.11 card. In another implementation, the input/output device can include driver devices configured to receive input data and send output data to other input/output devices, e.g., keyboard, printer and display devices 760. Other implementations, however, can also be used, such as mobile computing devices, mobile communication devices, set-top box television client devices, etc.

Although an example processing system has been described in FIG. 7, implementations of the subject matter and the functional operations described in this specification can be implemented in other types of digital electronic circuitry, or in computer software, firmware, or hardware, including the structures disclosed in this specification and their structural equivalents, or in combinations of one or more of them.

Embodiments of the subject matter and the operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTML page) to a client device (e.g., for purposes of displaying data to and receiving user input from a user interacting with the client device). Data generated at the client device (e.g., a result of the user interaction) can be received from the client device at the server.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A method performed by data processing apparatus, the method comprising:

receiving, from a first content distributor, a first bid specifying a first amount that the first content distributor will pay for distribution of first content in a co-sponsored content item that includes content from another content distributor;

receiving, from a second content distributor that is different from the first content distributor, a second bid specifying a second amount that the second content distributor will pay for distribution of second content with in a co-sponsored content item that includes content from another content distributor;

generating a co-sponsored content item that includes both the first content and the second content;

computing a total bid for the co-sponsored content item that includes the first content and the second content, the total bid being computed based on a function of both the first bid for the first content distributor and the second bid for the second content distributor;

receiving a request for a content item to be presented in a presentation slot of a publisher property;

selecting, based on an outcome of an auction performed using the total bid as one of a plurality of bids, the co-sponsored content item to be provided for presentation in the presentation slot in response to the request for a content item; and providing data that cause presentation of the co-sponsored content item in the presentation slot of the publisher property.

2. The method of claim 1, further comprising:

receiving, from the first content distributor, data specifying a content template that the first content distributor has selected for creating the content item, the content template specifying a first portion for presentation of the first content, and further specifying a second portion of the template that is reserved for content from another content distributor; and inserting the first content into the first portion of the template and the second content into the second portion of the template to create the co-sponsored content item including the first content and the second content.

3. The method of claim 2, further comprising associating at least one uniform resource locator with content included in the co-sponsored content item, wherein user selection of the content associated with the uniform resource locator initiates a request for a resource associated with the uniform resource locator.

4. The method of claim 3, wherein associating at least one uniform resource locator with content included in the co-sponsored content item comprises associating a first uniform resource locator with the first content, wherein user selection of the first content initiates a request for a first resource associated with the first content distributor.

5. The method of claim 4, wherein associating at least one uniform resource locator with content included in the co-sponsored content item further comprises associating a second uniform resource locator, different from the first uniform resource locator, with the second content, wherein user select of the second content initiates a request for a second resource that is different from the first resource.

6. The method of claim 1, further comprising:

receiving, from a third content distributor, a third bid specifying a third amount that the third content distributor will pay for distribution of third content with the first content; the amount being less than the second amount; and selecting, based on an outcome of an auction performed using the second bid and the third bid, the second content as content to be distributed with the first content.

7. The method of claim 1, further comprising:

receiving, from the second content distributor, an available content request specifying co-sponsor preferences with which available content is selected;

selecting available content having attributes that match the co-sponsor preferences; and providing, in response to the available content request and to the second content distributor, data specifying available content for inclusion in the co-sponsored content item with the second content, the available content including the first content.

8. The method of claim 1, wherein receiving the first bid comprises receiving a null bid specifying a value of zero.

9. The method of claim 1, wherein computing a total bid comprises computing a mathematical sum of the first bid and the second bid.

10. The method of claim 1, wherein:

the first content comprises first advertisement content;

the second content comprises second advertisement content;

the publisher property is a publisher web page; and the content item comprises an advertisement including the first advertisement content and the second advertisement content.

11. The method of claim 1, wherein receiving the second bid comprises receiving a negative bid.

12. A computer storage medium encoded with a computer program, the program comprising instructions that when executed by one or more data processing apparatus cause the data processing apparatus to perform operations comprising:

receiving, from a first content distributor, a first bid specifying a first amount that the first content distributor will pay for distribution of first content in a co-sponsored content item that includes content from another content distributor;

receiving, from a second content distributor that is different from the first content distributor, a second bid specifying a second amount that the second content distributor will pay for distribution of second content with in a co-sponsored content item that includes content from another content distributor;

generating a co-sponsored content item that includes both the first content and the second content;

computing a total bid for the co-sponsored content item that includes the first content and the second content, the total bid being computed based on a function of both the first bid and the second bid;

receiving a request for a content item to be presented in a presentation slot of a publisher property;

selecting, based on an outcome of an auction performed using the total bid as one of a plurality of bids, the co-sponsored content item to be provided for presentation in the presentation slot in response to the request for a content item; and providing data that cause presentation of the co-sponsored content item in the presentation slot of the publisher property.

13. A system comprising:

a data store storing content for a plurality of content distributors and respective bids that are respectively associated with the content provided by the content distributors, each respective bid specifying an amount that will be paid for distribution of the content with which the respective bid is associated; and a data processing apparatus coupled to the data store, the data processing apparatus comprising one or more computers configured to generate and provide a co-sponsored content item in response to receipt of a content item request that requests a content item for presentation in a presentation slot of a publisher property, the co-sponsored content item being generated to include first content from a first content provider and second content from a second content provider that are each selected from the data store, the first content and the second content being selected in response to a determination that a match exists between attributes of the first content and co-sponsor preferences associated with the second content and that a match exists between attributes of the second content and co-sponsor preferences associated with the first content, the single co-sponsored content item being selected to be provided in response to the request based on a total bid for the single co-sponsored content item, the total bid being computed by the data processing apparatus based on a first bid from the first content provider and a second bid from the second content provider.

14. The system of claim 13, wherein the data processing apparatus is further configured to:

receive data specifying a content template that has been selected for creating the co-sponsored content item, the content template specifying a first portion for presentation of the first content, and further specifying a second portion for presentation of the second content; and insert the first content into the first portion of the template and insert the second content into the second portion of the template to create the co-sponsored content item including the first content and the second content.

15. The system of claim 14, wherein the data processing apparatus is further configured to associate at least one uniform resource locator with content included in the co-sponsored content item, wherein user selection of the content associated with the uniform resource locator initiates a request for a resource associated with the uniform resource locator.

16. The system of claim 15, wherein the at least one uniform resource locator comprises a first uniform resource locator that is associated with the first content, wherein user selection of the first content initiates a request for a first resource associated with the first content provider.

17. The system of claim 16, wherein the at least one uniform resource locator further comprises a second uniform resource locator that is different from the first uniform resource locator and associated with the second content, wherein user select of the second content initiates a request for a second resource that is different from the first resource.

18. The system of claim 13, wherein the data processing apparatus is further configured to select the second content from among other content that is associated with bids specifying amounts that other content distributors will pay for inclusion of the other content in final content with the first content.

19. The system of claim 13, wherein the data processing apparatus is further configured to:

receive, from a third content distributor, a third bid specifying a third amount that the third content distributor will pay for distribution of third content with the first content; the third amount being less than the amount specified by the bid for the second content; and select, based on an outcome of an auction performed using the second bid and the third bid, the second content as content to be distributed with the first content.

20. The system of claim 13, wherein the data processing apparatus is further configured to:

receive, from a second content distributor that is associated with the second content, an available content request specifying co-sponsor preferences with which available content is selected, select available content having attributes that match the co-sponsor preferences; and provide, in response to the available content request and to the second content distributor, data specifying available content for inclusion in the co-sponsored content item with the second content, the available content including the first content.

21. A method performed by data processing apparatus, the method comprising:

receiving, from a first content distributor, a first bid and first co-sponsor preferences, the first bid specifying a first amount that the first content distributor will pay for distribution of the first content, the first co-sponsor preferences specifying attributes with which other content must be associated in order for the other content to be included in a co-sponsored content item with the first content;

receiving, from a second content distributor, a second bid and second co-sponsor preferences, the second bid specifying a second amount that the second content distributor will pay for distribution of the second content, the second co-sponsor preferences specifying attributes with which other content must be associated in order for the other content to be included in a co-sponsored content item with the second content;

determining that the first content is associated with attributes that satisfy the second co-sponsor preferences and that the second content is associated with attributes that satisfy the first co-sponsor preferences;

creating a co-sponsored content item that includes both the first content and the second content; and computing a total bid for the co-sponsored content item, the total bid being computed based on a mathematical operation performed using the first bid and the second bid; and performing an auction based on a set of bids that includes the total bid.

* * * * *